US007032970B1

(12) United States Patent
Kharat

(10) Patent No.: US 7,032,970 B1
(45) Date of Patent: Apr. 25, 2006

(54) BOOSTER CHAIR ASSEMBLY

(76) Inventor: Thabit Kharat, 1156 3 Aspendell Dr., San Diego, CA (US) 92131

( * ) Notice: Subject to any disclaimer, the term of this patent is extended or adjusted under 35 U.S.C. 154(b) by 0 days.

(21) Appl. No.: 11/055,763

(22) Filed: Feb. 11, 2005

(51) Int. Cl.
*A47D 1/10* (2006.01)

(52) U.S. Cl. ..... 297/256.11; 297/344.18

(58) Field of Classification Search ..... 297/250.1, 297/252, 256.11, 344.18, 467
See application file for complete search history.

(56) References Cited

U.S. PATENT DOCUMENTS

| | | | | | |
|---|---|---|---|---|---|
| 2,515,527 | A | * | 7/1950 | Robinson | 297/311 |
| 2,521,281 | A | * | 9/1950 | Brousseau | 248/421 |
| 2,570,687 | A | | 10/1951 | Kahn | |
| 2,625,987 | A | * | 1/1953 | Hunter | 297/174 R |
| 2,717,633 | A | * | 9/1955 | Hartmann | 297/252 |
| 2,935,122 | A | * | 5/1960 | Miller | 297/256.11 |
| 4,109,961 | A | | 8/1978 | Opsvik | |
| D283,855 | S | | 5/1986 | Kujawski | |
| 4,603,903 | A | | 8/1986 | Moscovitch | |
| 4,770,410 | A | * | 9/1988 | Brown | 297/485 |
| 4,854,638 | A | | 8/1989 | Marcus et al. | |
| 5,183,311 | A | | 2/1993 | Meeker et al. | |
| 5,427,438 | A | * | 6/1995 | Fochs | 297/467 |
| 5,474,355 | A | | 12/1995 | Lerner et al. | |
| 5,526,537 | A | * | 6/1996 | Conrad | 297/188.12 |
| 5,685,604 | A | | 11/1997 | Kain | |
| 6,299,247 | B1 | * | 10/2001 | Meeker et al. | 297/137 |

* cited by examiner

*Primary Examiner*—Peter R. Brown

(57) ABSTRACT

A booster chair assembly includes a base that has a top side and a bottom side. A plurality of posts is attached to and extends upwardly from the base. The plurality of posts includes a first front post, a second front post, a first rear post and a second rear post. Each of the posts is selectively telescoping so that a height of each of the posts is adjustable. Each of the posts has a top end. The posts each include a bottom portion and a top portion. The bottom portions are each is slidably extendable into a corresponding one of the top portions. A seat is attached to each of the posts and is horizontally orientated. The seat is attached to the top portions of the posts. A backrest is attached to and extends between the first and second rear posts.

7 Claims, 5 Drawing Sheets

BOOSTER CHAIR ASSEMBLY

BACKGROUND OF THE INVENTION

1. Field of the Invention

The present invention relates to highchair devices and more particularly pertains to a new highchair device for attaching to a chair and which is adjustable to allow for variances in table height and the height of a child.

2. Description of the Prior Art

The use of highchair devices is known in the prior art. U.S. Pat. No. 2,570,687 describes an adjustable chair device for the relative positioning of a child with respect to a table. Another type of highchair device is U.S. Pat. No. 5,474,355 which includes a booster chair and highchair combination device. U.S. Pat. No. 5,183,311 includes a portable booster seat assembly.

While these devices fulfill their respective, particular objectives and requirements, the need remains for a booster chair device that is portable and which can be selectively attached to a chair. The booster chair is preferably adjustable so that its height may be adjustable to take into account variances in chair height and in the height of a child. The device allows for a more portable booster chair as the user of the device need to be concerned about the height of the chair onto which it is going to be placed.

SUMMARY OF THE INVENTION

The present invention meets the needs presented above by comprising a base that has a top side and a bottom side. A plurality of posts is attached to and extends upwardly from the base. The plurality of posts includes a first front post, a second front post, a first rear post and a second rear post. Each of the posts is selectively telescoping so that a height of each of the posts is adjustable. Each of the posts has a top end. The posts each include a bottom portion and a top portion. The bottom portions are each is slidably extendable into a corresponding one of the top portions. A seat is attached to each of the posts and is horizontally orientated. The seat is attached to the top portions of the posts. A backrest is attached to and extends between the first and second rear posts.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
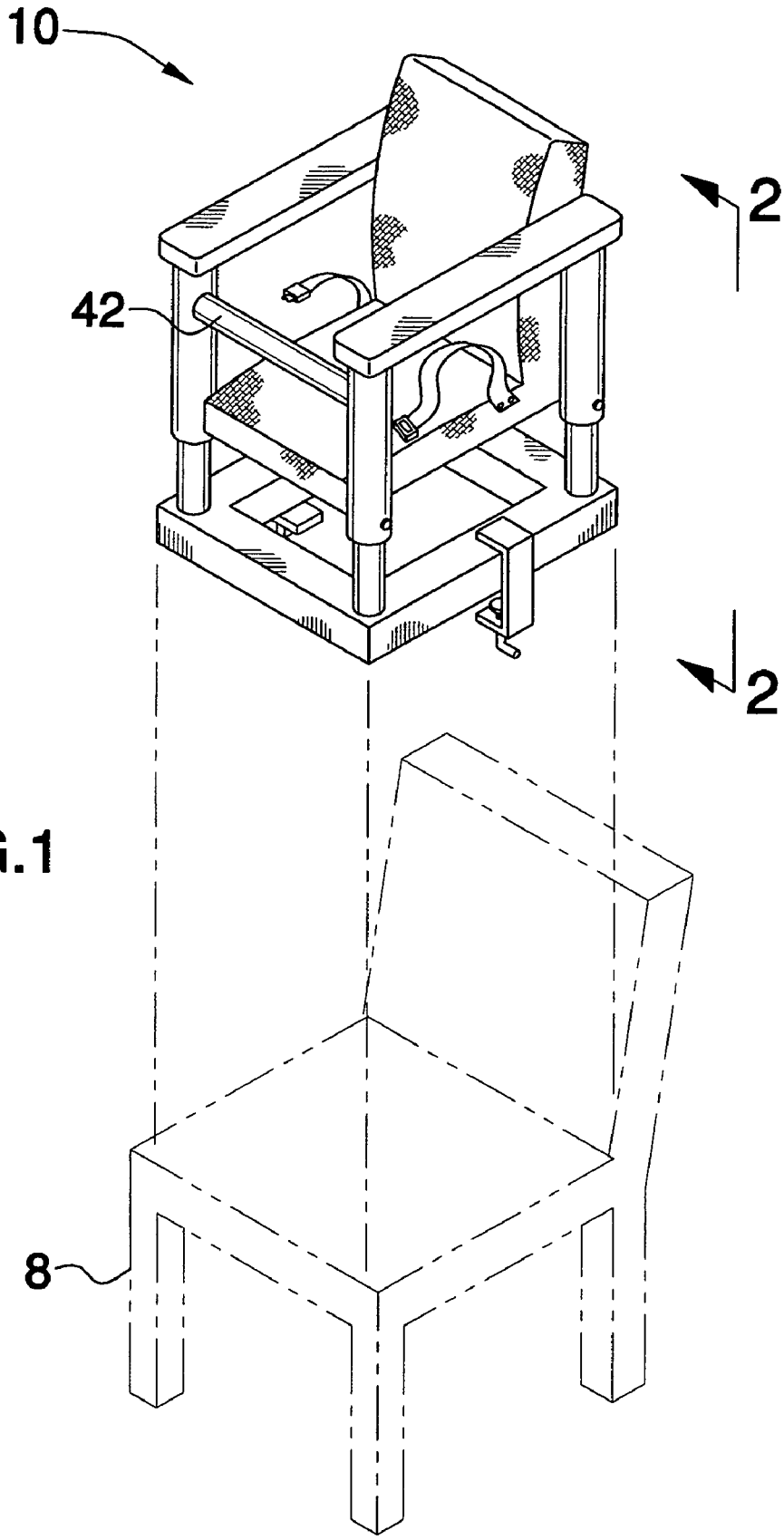
FIG. 1 is a perspective view of a booster chair assembly according to the present invention.
Figure 2:
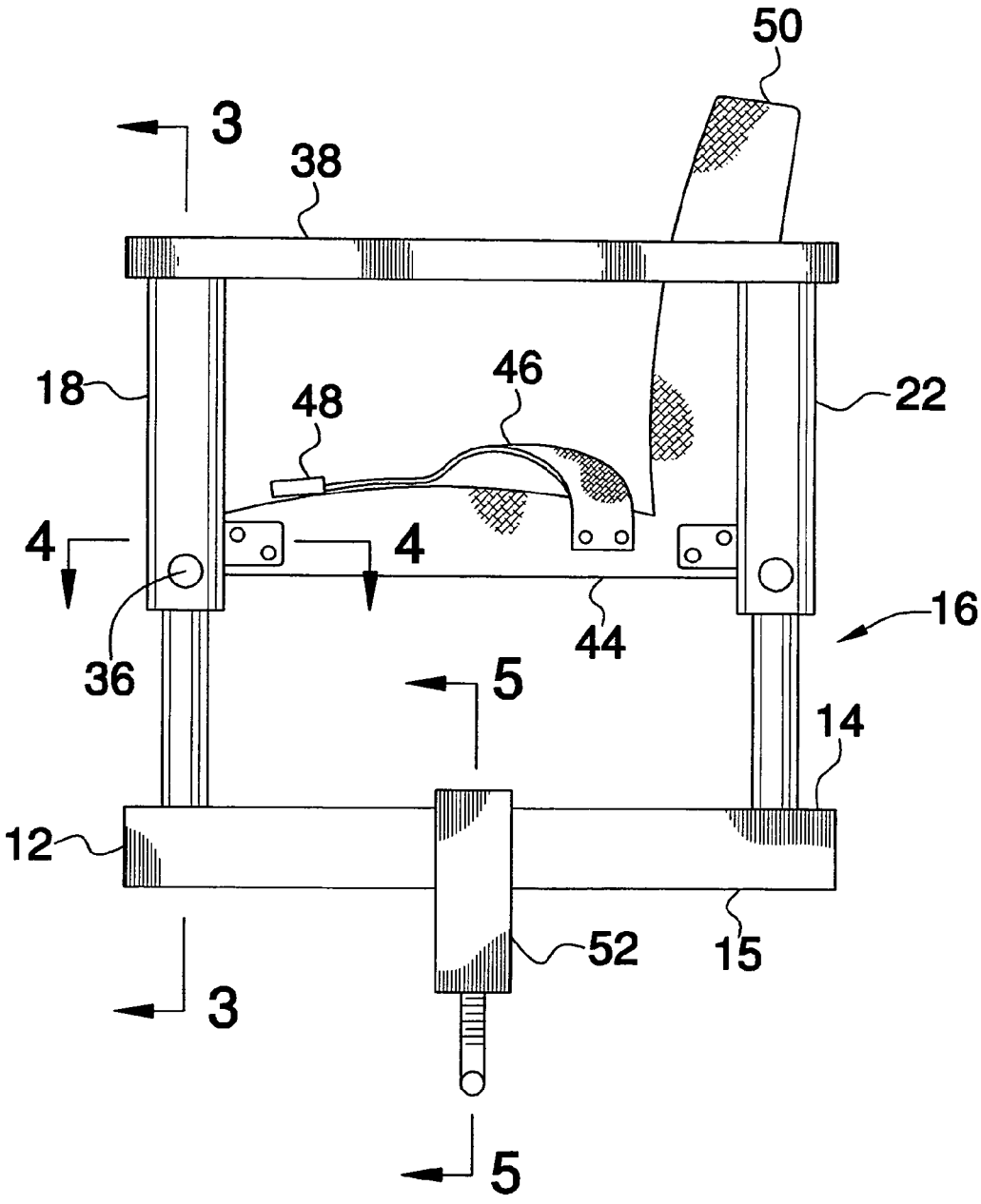
FIG. 2 is a right side view of the present invention.
Figure 3:
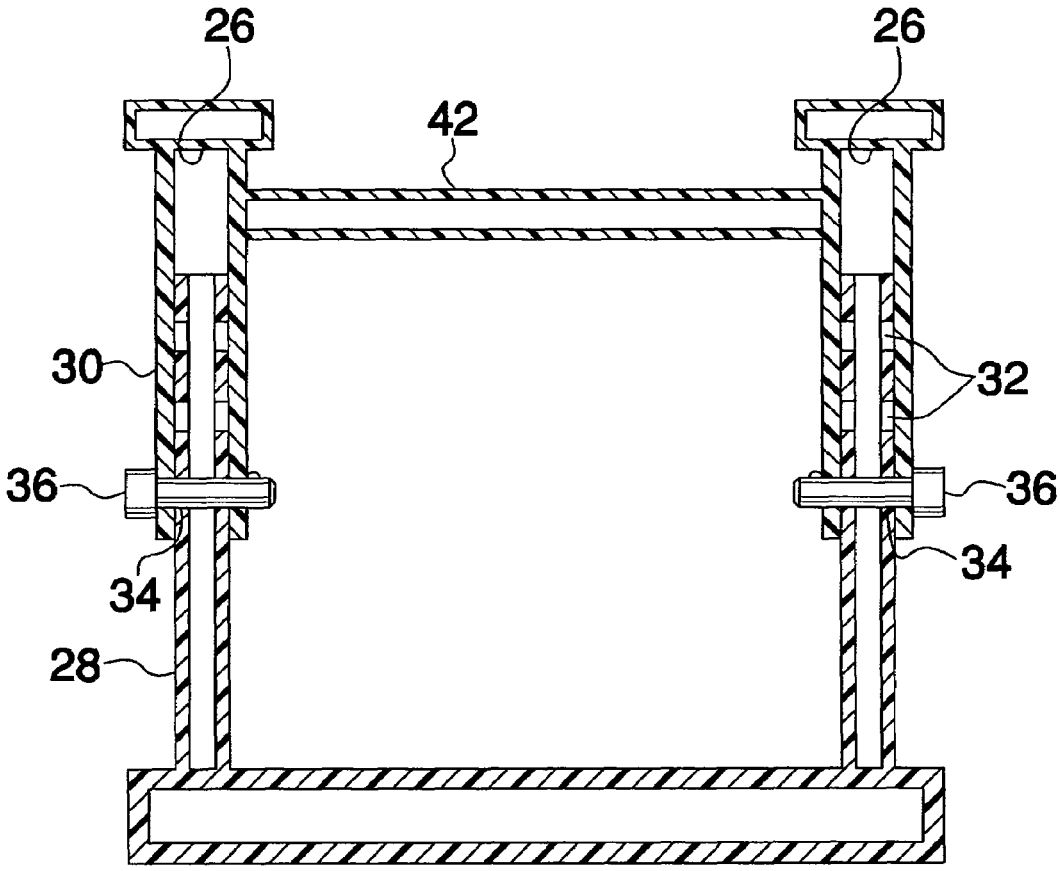
FIG. 3 is a cross-sectional view taken along line 3—3 of FIG. 2 of the present invention.
Figure 4:
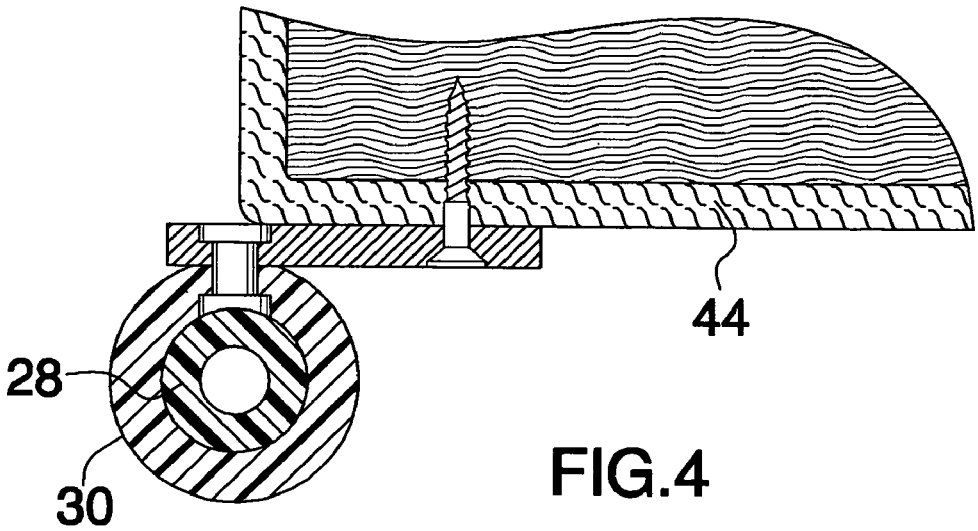
FIG. 4 is a cross-sectional view taken along line 4—4 of FIG. 2 of the present invention.
Figure 5:
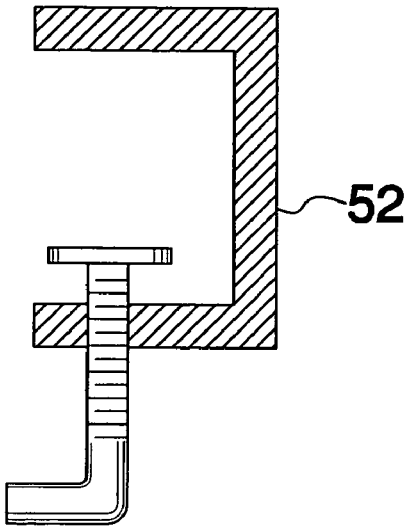
FIG. 5 is a cross-sectional view taken along line 5—5 of FIG. 2 of the present invention.
Figure 6:
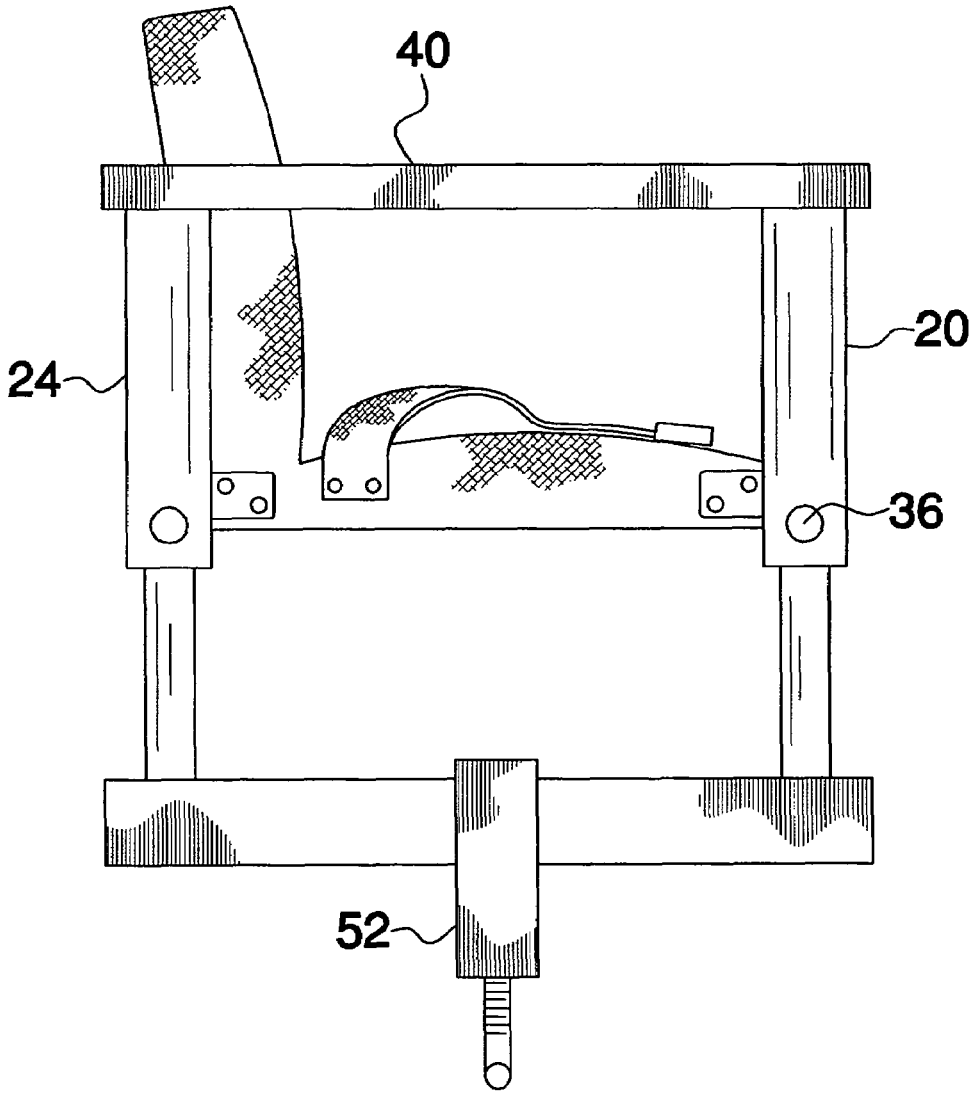
FIG. 6 is a left side view of the present invention.

With reference now to the drawings, and in particular to FIGS. 1 through 6 thereof, a new booster chair device embodying the principles and concepts of the present invention and generally designated by the reference numeral 10 will be described.

As best illustrated in FIGS. 1 through 6, the booster chair assembly 10 generally comprises a base 12 that has a top side 14 and a bottom side 15. A plurality of posts 16 is attached to and extends upwardly from the base 12. The plurality of posts 16 includes a first front post 18, a second front post 20, a first rear post 22 and a second rear post 24. Each of the posts 16 is selectively telescoping so that a height of each of the posts 16 is adjustable. Each of the posts 16 has a top end 26 and includes a bottom portion 28 and a top portion 30. Each of the bottom portions 28 is slidably extendable into a corresponding one of the top portions 30. The bottom portions 28 each have a plurality of pairs of axially aligned openings 32 therein and each of the top portions 30 has one pair of axially apertures 34 therein. Each of a plurality of pins 36 is removably extendable through aligned ones of the openings 32 and the apertures 34.

A first armrest 38 is attached to and extends between top ends 26 of the first front post 18 and the first rear post 22. A second armrest 40 is attached to and extends between the top ends 26 of the second front post 20 and the second rear post 24. A rod 42 is attached to and extends between the first 18 and second 20 front posts. The rod 42 is positioned generally adjacent to the top ends 26.

A seat 44 is attached to each of the posts 16 and is horizontally orientated. The seat 44 is attached to the top portions 30 of the posts 16. A strap 46 is attached to the seat. The strap 46 includes a pair of sections. A buckle 48 is attached to the sections for selectively attaching the sections together. A backrest 50 is attached to and extends between the first 22 and second 24 rear posts. The backrest 50 is generally vertically orientated and extends from the seat 44 and upwardly above the top ends 26.

Each of a pair of clamps 52 is attached to the base. The clamps 52 are adapted for removably attaching the base 12 to a chair 8. The clamps 52 are adjustable to allow for variance in chair thickness.

In use, the clamps 52 are attached to a chair 8 so that the base 12 is secured to the chair 8 and the posts 16 extend upwardly from the chair 8. The posts 16 are adjustable so ensure that a child positioned on the seat 44 is properly located with respect to an adjacent table.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable booster chair assembly for removably attaching to a chair, said assembly including:

a base having a top side and a bottom side;

a plurality of posts being fixedly attached to and extending upwardly from said base, said plurality of posts including a first front post, a second front post, a first rear post and a second rear post, each of said posts being selectively telescoping such that a height of each of said posts is adjustable, each of said posts having a top end, each of said posts including a bottom portion and a top portion, each of said bottom portions being slidably extendable into a corresponding one of said top portions;

a seat being attached to each of said posts and being horizontally orientated, said seat being fixedly attached to said top portions of said posts, said seat having four corners, each of said posts being positioned adjacent to one of said corners;

a backrest being attached to and extending between said first and second rear posts; and a pair of clamps, each of said clamps being attached to said base, each of said clamps being adapted for removably attaching said base to a chair.

2. The assembly according to claim 1, each of said bottom portions having a plurality of pairs of axially aligned openings therein, each of said top portions having one pair of axially apertures therein, each of a plurality of pins being removably extendable through aligned ones of said openings and said apertures.

3. The assembly according to claim 1, further including a first armrest being attached to and extending between top ends of said first font post and said first rear post, a second armrest being attached to and extending between said top ends or said second front post and said second rear post.

4. The assembly according to claim 3, further including a rod being attached to and extending between said first and second front posts, said rod being positioned generally adjacent to said top ends.

5. The assembly according to claim 1, further including a rod being attached to and extending between said first and second front posts, said rod being positioned generally adjacent to said top ends.

6. The assembly assembly according to claim 1, further including a strap being attached to said seat, said strap including a pair of sections, a buckle being attached to said sections for selectively attaching said sections together.

7. An adjustable booster chair assembly for removably attaching to a chair, said assembly including:

a base having a top side and a bottom side;

a plurality of posts being fixedly attached to and extending upwardly from said base, said plurality of posts including a first front post, a second front post, a first rear post and a second rear post, each of said posts being selectively telescoping such that a height of each of said posts is adjustable, each of said posts having a top end, each of said posts including a bottom portion and a top portion, each of said bottom portions being slidably extendable into a corresponding one of said top portions, each of said bottom portions having a plurality of pairs of axially aligned openings therein, each of said top portions having one pair of axially apertures therein, each of a plurality of pins being removably extendable through aligned ones of said openings and said apertures;

a first armrest being attached to and extending between top ends of said first front post and said first rear post;

a second armrest being attached to and extending between said top ends of said second front post and said second rear post;

a rod being attached to and extending between said first and second front posts, said rod being positioned generally adjacent to said top ends;

a seat being attached to each of said posts and being horizontally orientated, said seat being fixedly attached to said top portions of said posts, said seat having four corners, each of said posts being positioned adjacent to one of said corners;

a strap being attached to said seat, said strap including a pair of sections, a buckle being attached to said sections for selectively attaching said sections together;

a backrest being attached to and extending between said first and second rear posts, said backrest being generally vertically orientated and extending from said seat and upwardly above said top ends; and a pair of clamps, each of said clamps being attached to said base, each of said clamps being adapted for removably attaching said base to a chair.

* * * * *